US009782871B2

(12) United States Patent
Suratwala et al.

(10) Patent No.: US 9,782,871 B2
(45) Date of Patent: Oct. 10, 2017

(54) APPARATUS AND METHOD FOR DETERMINISTIC CONTROL OF SURFACE FIGURE DURING FULL APERTURE PAD POLISHING

(71) Applicant: LAWRENCE LIVERMORE NATIONAL SECURITY, LLC., Livermore, CA (US)

(72) Inventors: Tayyab Ishaq Suratwala, Pleasanton, CA (US); Michael Douglas Feit, Livermore, CA (US); William Augustus Steele, Tracy, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 903 days.

(21) Appl. No.: 14/055,780

(22) Filed: Oct. 16, 2013

(65) Prior Publication Data

US 2014/0335767 A1 Nov. 13, 2014
US 2017/0190016 A9 Jul. 6, 2017

Related U.S. Application Data

(62) Division of application No. 12/695,986, filed on Jan. 28, 2010, now Pat. No. 8,588,956.
(Continued)

(51) Int. Cl.
*B24B 37/04* (2012.01)
*B24B 37/10* (2012.01)
(Continued)

(52) U.S. Cl.
CPC ..... *B24B 37/042* (2013.01); *B24B 13/00* (2013.01); *B24B 37/04* (2013.01); *B24B 37/10* (2013.01);
(Continued)

(58) Field of Classification Search
CPC ..... B24B 37/04; B24B 37/042; B24B 37/10; B24B 37/102; B24B 37/105; B24B 37/30; B24B 37/32; B24B 53/012; B24B 53/12
(Continued)

(56) References Cited

U.S. PATENT DOCUMENTS 5,536,202 A * 7/1996 Appel ..... B24B 53/017 451/285
5,643,067 A * 7/1997 Katsuoka ..... B24B 53/017 451/211
(Continued)

FOREIGN PATENT DOCUMENTS

JP 05-116081 5/1993
JP 2003-068688 7/2003
(Continued)

OTHER PUBLICATIONS 201010108155.9, "Office Action", dated Oct. 26, 2011, 8 pages.
(Continued)

*Primary Examiner* — Eileen Morgan
(74) *Attorney, Agent, or Firm* — Kilpatrick Townsend & Stockton LLP

(57) ABSTRACT

A polishing system configured to polish a lap includes a lap configured to contact a workpiece for polishing the workpiece; and a septum configured to contact the lap. The septum has an aperture formed therein. The radius of the aperture and radius the workpiece are substantially the same. The aperture and the workpiece have centers disposed at substantially the same radial distance from a center of the lap. The aperture is disposed along a first radial direction from the center of the lap, and the workpiece is disposed along a second radial direction from the center of the lap. The first and second radial directions may be opposite directions.

15 Claims, 8 Drawing Sheets

Related U.S. Application Data

(60) Provisional application No. 61/148,236, filed on Jan. 29, 2009.

(51) Int. Cl.
*B24B 37/32* (2012.01)
*B24B 53/12* (2006.01)
*B24B 13/00* (2006.01)
*B24B 53/017* (2012.01)

(52) U.S. Cl.
CPC ..... *B24B 37/32* (2013.01); *B24B 53/017* (2013.01); *B24B 53/12* (2013.01)

(58) Field of Classification Search
USPC ... 451/41, 56, 443, 285, 286, 287, 288, 289, 451/290, 57
See application file for complete search history.

(56) References Cited

U.S. PATENT DOCUMENTS 5,681,212 A * 10/1997 Hayakawa ..... B24B 37/30 451/288
5,749,771 A * 5/1998 Isobe ..... B24B 53/017 451/285
5,762,539 A * 6/1998 Nakashiba ..... B24B 49/16 451/285
6,004,193 A * 12/1999 Nagahara ..... B24B 53/017 451/285
6,027,397 A 2/2000 Church et al.
6,132,290 A 10/2000 Sugiyama et al.
6,136,710 A * 10/2000 Quek ..... B24B 37/32 438/691
6,200,207 B1 * 3/2001 Hsu ..... B24B 53/017 451/287
6,224,472 B1 * 5/2001 Lai ..... B24B 37/32 451/288
6,330,488 B1 12/2001 Yoshida et al.
6,506,097 B1 1/2003 Adams et al.
6,632,124 B2 10/2003 Adams et al.
6,699,107 B2 * 3/2004 Stoeckgen ..... B24B 37/32 451/289
6,752,698 B1 * 6/2004 Renteln ..... B24B 21/10 451/56
6,806,193 B2 * 10/2004 Korthuis ..... B24B 37/32 216/88
6,821,192 B1 * 11/2004 Donohue ..... B24B 37/32 451/285
6,893,327 B2 * 5/2005 Kajiwara ..... B24B 37/32 451/285
RE39,195 E * 7/2006 Doan ..... B24D 7/18 451/287
2001/0039172 A1 11/2001 Kimura
2003/0070756 A1 * 4/2003 Hung ..... B24B 37/32 156/345.12
2004/0123951 A1 * 7/2004 Kramer ..... B24B 37/32 156/345.12
2004/0180610 A1 * 9/2004 Togawa ..... B24B 37/30 451/41
2004/0248411 A1 12/2004 Ushio et al.
2006/0009127 A1 1/2006 Sakurai et al.
2007/0049184 A1 * 3/2007 Venigalla ..... B24B 37/32 451/285
2007/0287367 A1 12/2007 Kim et al.
2009/0104863 A1 4/2009 Lin et al.
2009/0247060 A1 * 10/2009 Aritomo ..... B24B 37/32 451/365

FOREIGN PATENT DOCUMENTS

JP 2006043873 A 2/2006
JP 2007048862 A 2/2007
JP 2007-231949 9/2007
JP 5363367 9/2013
WO WO01/10599 2/2001

OTHER PUBLICATIONS

CN201010108155.9, "Office Action", dated Dec. 20, 2012, 3 pages.
CN201010108155.9, "Office Action", dated May 21, 2012, 10 pages.
CN201010108155.9, "Office Action Response", dated Jul. 20, 2012, 1 page.
EP10152206, "Extended European Search Report", dated Dec. 10, 2010, 8 pages.
JP201019742, "Notice of Allowance", dated Aug. 26, 2013, 3 pages.
JP2010-19742, "Office Action", dated Feb. 27, 2013, 7 Pages.
JP2010-19742, "Office Action", dated May 19, 2012, 17 pages.

* cited by examiner

APPARATUS AND METHOD FOR DETERMINISTIC CONTROL OF SURFACE FIGURE DURING FULL APERTURE PAD POLISHING

CROSS-REFERENCE TO RELATED APPLICATIONS

This application is a divisional of U.S. Patent Application Ser. No. 12/695,986 filed Jan. 28, 2010, entitled "APPARATUS AND METHOD FOR DETERMINISTIC CONTROL OF SURFACE FIGURE DURING FULL APERTURE PAD POLISHING", which is incorporated herein by this reference.

STATEMENT AS TO RIGHTS TO INVENTIONS MADE UNDER FEDERALLY SPONSORED RESEARCH OR DEVELOPMENT

The United States Government has rights in this invention pursuant to Contract No. DE-AC52-07N27344 between the United States Department of Energy and Lawrence Livermore National Security, LLC, for the operation of Lawrence Livermore National Security.

BACKGROUND OF THE INVENTION

The present invention generally relates to an apparatus and a method for shaping an optical surface. More particularly, the present relates to an apparatus and a method for generating a deterministic polishing process for an optical surface.

Optical elements, such as lenses and mirrors, in an optical system provide for the shaping of radiation fronts, such as light fronts. Shaping of radiation fronts may include focusing, culminating, dispersing, and the like. The shapes of the surfaces of optical elements are one feature of the optical elements that contribute to shaping radiation fronts as desired. The forming of optical surfaces of optical elements typically includes a series of basic process steps including: i) shaping, ii) grinding, iii) full-aperture polishing, and sometimes iv) sub-aperture polishing. With significant innovation and development over the years in i) shaping and iv) sub-aperture polishing, both shaping and sub-aperture polishing have become relatively deterministic. For example, with the advent of both computer numerical controlled (CNC) grinding machines and sub-aperture polishing tools, such as magnetorheological finishing (MRF), shaping and sub-aperture polishing have become more deterministic. That is, these processes may be applied to an optical element, and the resultant surface of the optical element will have a shape that is desired without significant human monitoring of the process. For example, a workpiece (e.g., a fused silica blank) might be placed in a CNC machine for shaping, and the CNC machine might shape the blank without the need for a human to stop the CNC machine to change any of the control parameters of the CNC machine.

However, the intermediate stages: ii) full aperture grinding and iii) full aperture polishing are relatively less deterministic processes. That is, various grinding techniques and polishing techniques may be applied to an optical element, but to achieve a desired surface shape, the attention, insight, and intuition of an optician are typically required to achieve the surface shape desired. Specifically, grinding techniques and polishing techniques are often applied to a surface iteratively because measurements of the surface are made as an optician monitors the applied techniques and makes adjustments to the techniques. Without the optician's monitoring and talents, the surfaces of optical elements during grinding and polishing are highly likely to have a shape that is not desired. That is, the resultant optical elements might not be useful for their intended purposes, such as shaping radiation fronts as desired, or the optical elements might be damaged (e.g., in high energy applications) during use due to less than optimal surface shape.

The ability to deterministically finish a surface during full aperture grinding and full aperture polishing will provide for obtaining a desired surface shape of an optical element in a manner that is relatively more repeatable, less intermittent, and relatively more economically feasible than traditional grinding and polishing techniques. The development of a scientific understanding of the material removal rate from a surface is one relatively important step in transitioning to deterministic grinding and polishing.

At the molecular level, material removal during glass polishing is dominated by chemical processes. The most common polishing media for silica glass is cerium oxide. Cerium oxide polishing can be described using the following basic reaction:

$$\text{=Ce—OH+HO—Si}\equiv\rightarrow\text{=Ce—O—Si}\equiv+H_2O \quad (1).$$

The surface of the cerium oxide particle is cerium hydroxide, which condenses with the glass surface (silanol surface) to form a Ce—O—Si bond. The bond strength of this new oxide is greater than the bond strength of the Si—O—Si bond (i.e., the glass). Hence, polishing is thought to occur as ceria particles repeatedly tear away individual silica molecules. It is well known that parameters such as pH, isoelectric point, water interactions, slurry concentration, slurry particle size distribution, and other chemical parameters can influence the removal rate of material from a surface.

At the macroscopic level, material removal from a surface has been historically described by the widely used Preston's equation:

$$\frac{dh}{dt} = k_p \sigma_o V_r$$

where dh/dt is the average thickness removal rate, $\sigma_o$ is the applied pressure of a lap on a workpiece, and $V_r$ is the average relative velocity of the polishing particle relative to the workpiece. The molecular level effects are described macroscopically by the Preston's constant ($k_p$). The molecular level effects include the effects of the particular slurry used for polishing. As can be seen from Preston's equation, the rate of removal of material from a surface of a workpiece increases linearly with pressure $\sigma_o$ and velocity $V_r$. Many studies, particularly those in the chemical mechanical polishing (CMP) literature for silicon wafer polishing, have expanded Preston's model to account for slurry fluid flow and hydrodynamic effects, Hertzian contact mechanics, influence of asperity microcontact, lap bending, and the mechanics of contact on the pressure distribution. Only a few of these studies focus on understanding and predicting surface shape (or global non-uniformity).

None of the foregoing mentioned studies has described the general case involving the interplay of these multiple effects such that the material removal and the final surface shape of the workpiece can be quantitatively determined. Therefore, new apparatus and methods are needed to measure and predict material removal and surface shape for a workpiece (such as a silica glass workpiece) that has been polished using polishing slurry (such as cerium oxide slurry)

on a lap (such as a polyurethane lap) under a systematic set of polishing conditions. Further, a spatial and temporal polishing apparatus and method are needed to simulate the experimental data incorporating: 1) the friction coefficient as function of velocity (Stribeck curve), 2) the relative velocity which is determined by the kinematics of the lap and workpiece motions, and 3) the pressure distribution, which is shown to be dominated by: a) moment forces, b) lap viscoelasticity; and c) workpiece-lap interface mismatch.

BRIEF SUMMARY OF THE INVENTION

The present invention generally relates to an apparatus and a method for an offer reporting system. More particularly, the present invention relates to an apparatus and a method for generating a deterministic polishing process for an optical surface.

One embodiment of the present invention includes a computerized method for determining an amount of material removed from a workpiece during a polishing process. The method includes receiving at a polishing system a set of polishing parameters, and determining on the polishing system a set of kinematic properties for a lap and a workpiece of the polishing system from at least a portion of the set of polishing parameters. The method further includes determining on the polishing system a time of exposure for a set of lap points on the workpiece based on at least a portion of the set of polishing parameters and the set of kinematic properties, and determining on the polishing system a friction force between the lap and the workpiece from at least a portion of the set of polishing parameters. The method further includes determining on the polishing system a slope between the lap and the work piece based on a moment force between the lap and the workpiece, wherein the moment force is based on the determined friction force, and determining on the polishing system a pressure distribution between the lap and the workpiece based on a information for a lap type included in the set of polishing parameters. The method further includes determining on the polishing system a cumulative pressure distribution between the lap and the workpiece based on the slope, the angle, the pressure distribution for the lap type, and the time of exposure; and determining on the polishing system an amount of material removed from the workpiece based on a product of the cumulative pressure distribution, the friction force, and the set of kinematic properties.

According to a specific embodiment of the present invention, each determining step is executed for a plurality of points on a surface of the workpiece. The method further includes executing each determining step for a plurality of successive time periods.

According to another specific embodiment, the set of polishing parameters includes a set of material properties, a set of polisher configuration parameters, and set of polisher kinematic properties. The set of material properties includes properties of the polishing system and includes information for a lap type, a Stribeck friction curve for the lap, and an optic-lap mismatch. The set of material properties may further include the Preston's constant for Preston's equation. The information for the lap type may be information to identify the lap type as viscoelastic, viscoplastic, or elastic. The set of polisher kinematic properties includes a rotation rate of the workpiece, a rotation rate of the lap, a stroke distance of the workpiece relative to the lap, and a stroke frequency. The set of polisher configuration parameters includes a workpiece shape, a lap shape, a workpiece size, a lap size, a lap curvature, a load distribution of the lap on the workpiece, and a moment of the workpiece relative to the lap.

According to another specific embodiment, the method further includes subtracting the amount of material removed from the workpiece shape for a first time period to determine a new workpiece shape for the first time period; and executing each determining step for a successive time period following the first time period using the new workpiece shape to determine a successive amount of material removed from the workpiece for the successive time period. The method may further include determining a set of control settings for the polishing system from the new workpiece shape and a final workpiece shape; and setting on the polishing system a set of controls to the set of control settings to adjust the polishing system to polish the workpiece shape to the final workpiece shape.

According to another embodiment of the present invention, a computer readable storage medium contains program instructions that, when executed by a controller within a computer, cause the controller to execute a method for determining an amount of material removed from a workpiece during a polishing process. The steps of the method are described above.

According to another embodiment of the present invention, a computer program product for determining an amount of material removed from a workpiece during a polishing process on a computer readable medium includes code for executing the method steps described above.

According to another embodiment of the present invention, a polishing system includes a lap configured to contact a workpiece for polishing the workpiece, and a septum configured to contact the lap. The septum has an aperture formed therein to receive the workpiece, and the lap is configured to contact the workpiece through the aperture. The polishing system further includes a first device configured to couple to the workpiece and place a first amount of pressure between the workpiece and the lap, and a second device coupled to the septum and configured to place a second amount of pressure between the septum and the lap to compress the lap as the workpiece is polished by the lap, wherein the second amount pressure is three or more times the first amount pressure.

According to a specific embodiment of the polishing system, the compression of the lap is configured to inhibit the workpiece from compressing the lap as the workpiece is polished by the lap. The compression of the lap is configured to substantially planarize the lap as the workpiece is polished by the lap. The polishing system may further include the workpiece.

According to another embodiment of the present invention, a polishing method is provided for pressing a lap with a septum to compress the lap during polishing of a workpiece to inhibit the workpiece from compressing the lap during the polishing. The method includes pressing on a workpiece with a first forcing device to place a first amount of pressure between a lap and a workpiece; and pressing on a septum with a second forcing device to place a second amount of pressure between the septum and the lap, wherein the septum has an aperture formed therein and the workpiece is configured to contact the lap through the aperture, and wherein the second amount of pressure is three or more times greater than the first amount of pressure. According to a specific embodiment, the method further includes rotating the lap with respect to the septum and the workpiece.

According to another embodiment of the present invention, a polishing system configured to polish a lap includes a lap configured to contact a workpiece for polishing the workpiece, and a septum configured to contact the lap. The septum has an aperture formed therein. The aperture has substantially the same radius as the workpiece. The aperture has a center disposed at a radial distance from a center of the lap, and disposed along a first radial direction of the lap. The workpiece has a center disposed at the radial distance from the center of the lap, and disposed along a second radial direction of the lap.

According to a specific embodiment of the polishing system, the septum is configured to polish the lap to a substantially planar surface as the lap polishes the workpiece. The first radius and the second radius are oppositely directed. The polishing system may further include the workpiece. The septum has a substantially triangular shape.

These and other embodiments of the present invention are described in more detail in conjunction with the text below and the attached figures.

Figure 7:
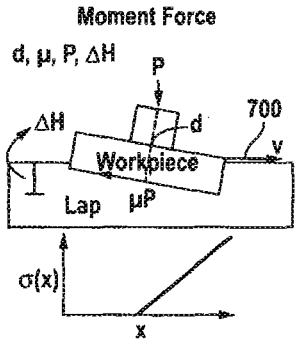
Figure 8A:
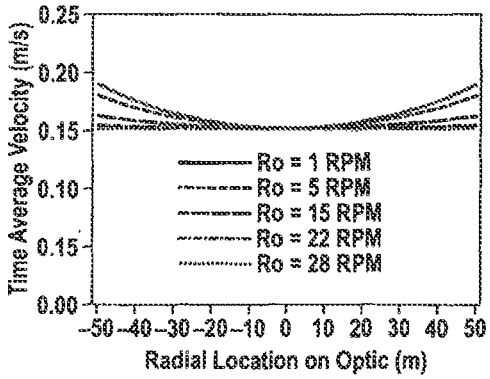
Figure 8B:
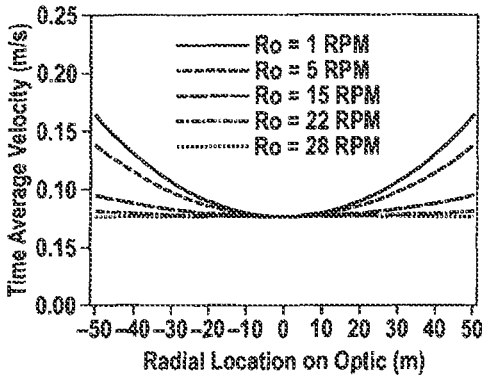
Figure 8C:
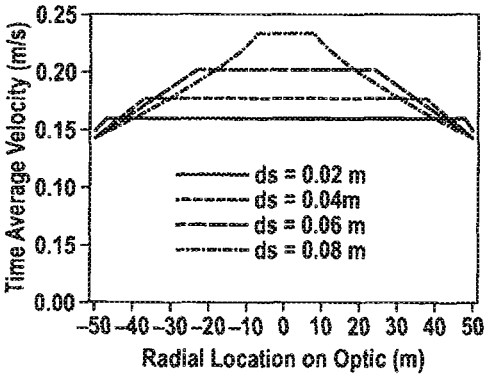
Figure 8D:
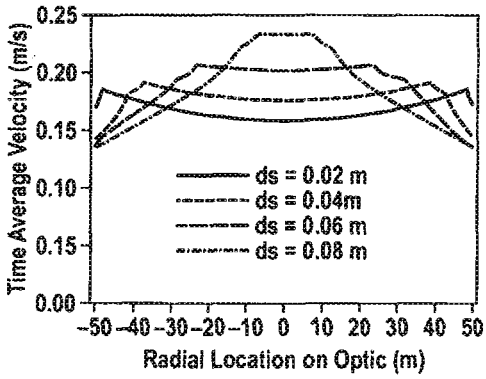
Figure 9A:
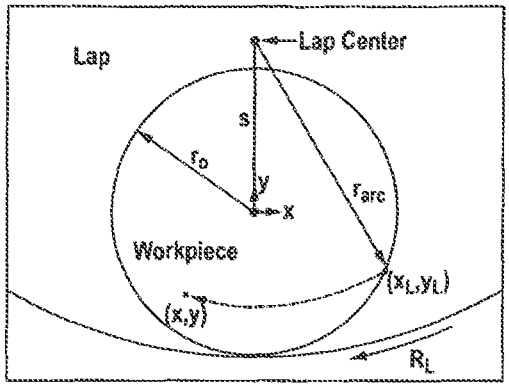
Figure 9B:
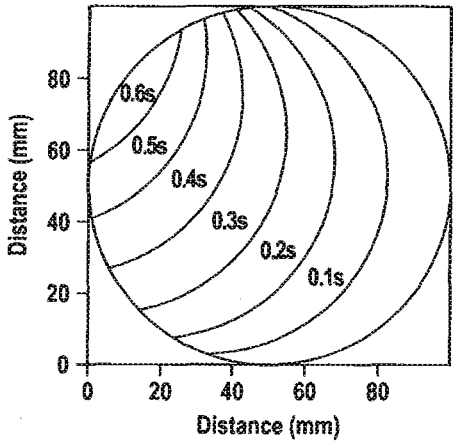
Figure 10:
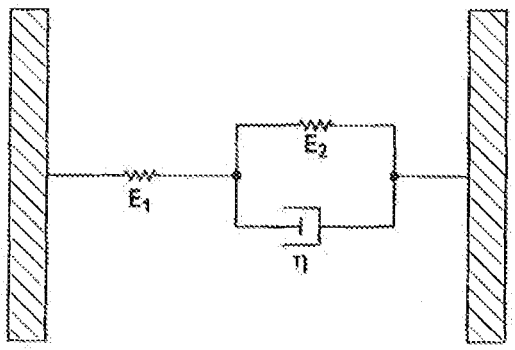
Figure 11A:
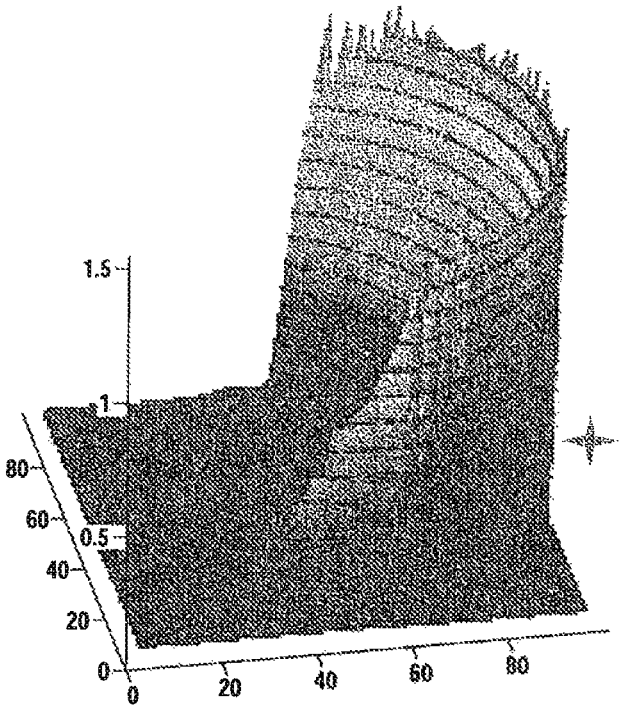
Figure 11B:
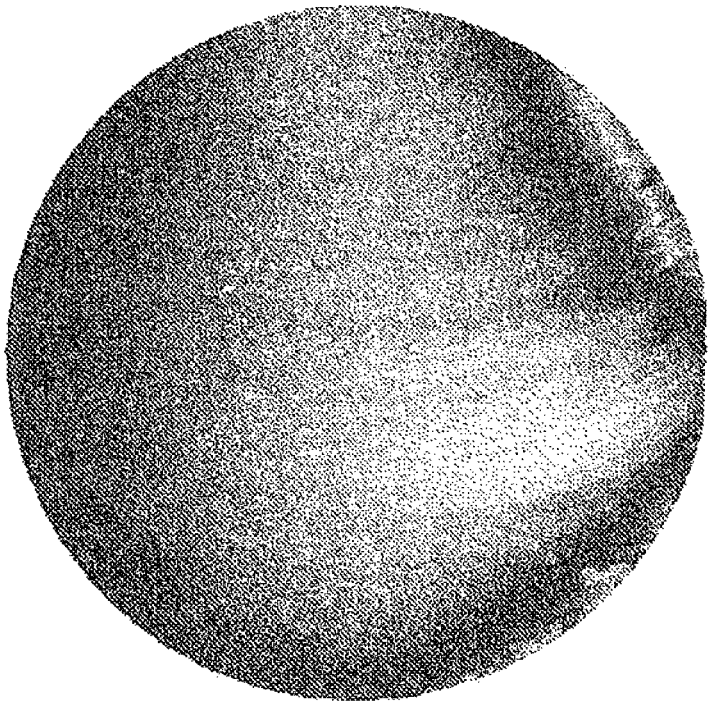
Figure 12:
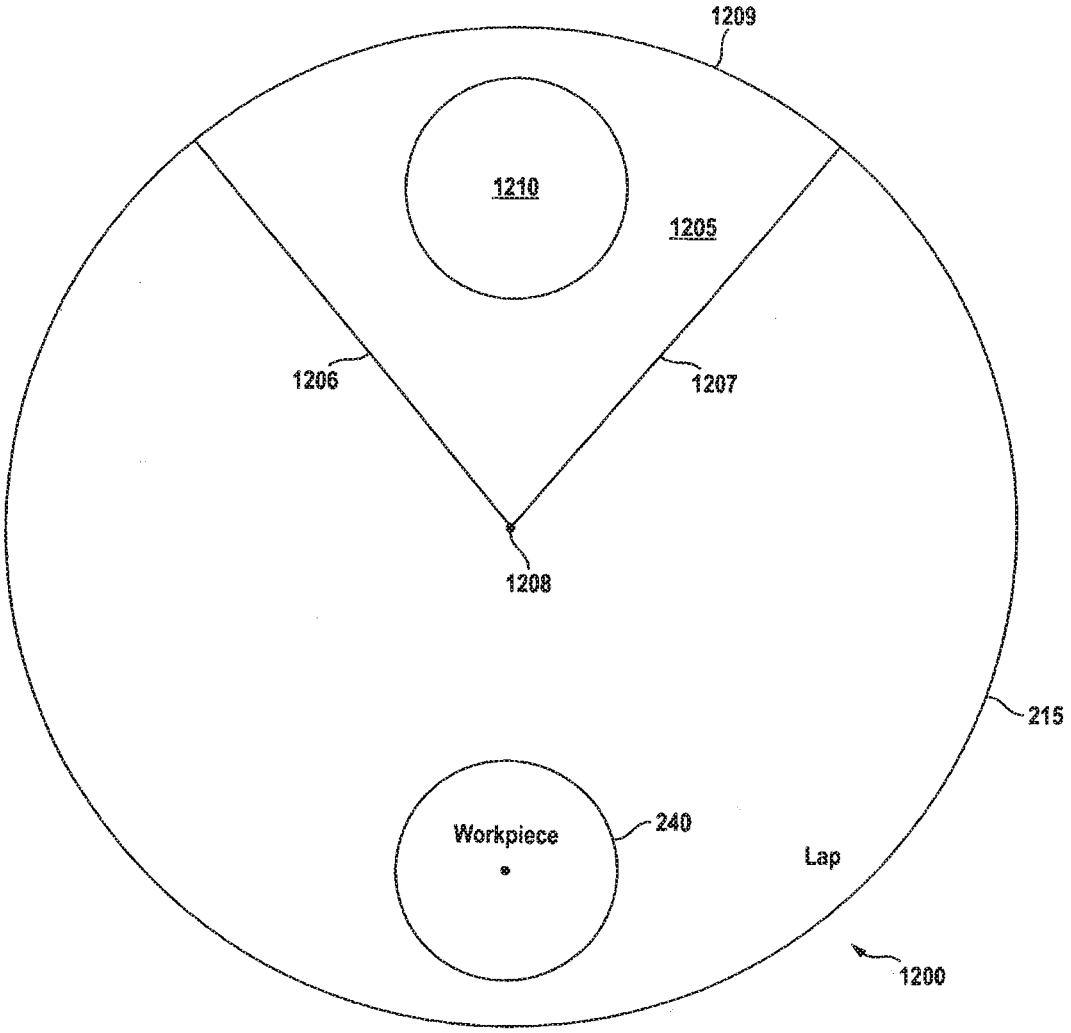

The graph at the bottom of FIG. 7 shows the pressure distribution of the lap on the workpiece due to the frictional forces for the workpiece moving in the direction of arrow 700;

FIGS. 8A and 8B are graphs that suggest that increasing the separation distance, tends to increase the time average velocity and hence the removal rate of material from the workpiece surface;

FIGS. 8C and 8D are graphs that illustrate that increasing the stroke distance generally leads to lower velocities at the edge of the workpiece due to the edge of the workpiece spending more time off of the lap, and hence the workpiece would become more concave;

FIG. 9A is a graph that illustrates that the time of lap exposure can be determined using a line path of some point on the lap $(x_L,y_L)$ at the leading edge of the workpiece as it travels to some given point on the workpiece (x,y);

FIG. 9B is a graph that shows the calculated time of lap exposure $t_L(x,y)$ for the conditions used for a sample workpiece;

FIG. 10 schematically illustrates the delayed elasticity viscosity model, which is comprised of two moduli (two springs) and one viscosity (dashpot);

FIG. 11A shows the calculated pressure distribution using the conditions described for a sample workpiece where the workpiece does not rotate;

FIG. 11B shows the measured surface profile for a sample workpiece after 1 hour of polishing according to one exemplary embodiment of the present invention; and FIG. 12 is a simplified top view of a polishing system according to another embodiment of the present invention.

APPARATUS AND METHOD FOR DETERMINISTIC CONTROL OF SURFACE FIGURE DURING FULL APERTURE PAD POLISHING

Detailed Description of Select Embodiments of the Invention

The present invention generally provides an apparatus and a method for shaping an optical surface. More particularly, the present invention provides an apparatus and a method for generating a deterministic polishing process for an optical surface.

Figure 1:
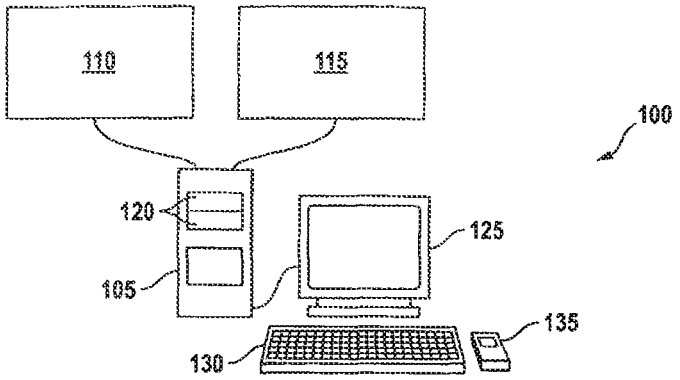
FIG. 1 is a simplified block diagram of a polishing system according to one embodiment of the present invention.

FIG. 1 is a simplified block diagram of a polishing system 100 according to one embodiment of the present invention. Polishing system 100 includes a computer system 105, a set of controls 110, and a set of polishing devices 115. Polishing system 100 is configured to polish a workpiece, such as an optical element, as described below.

Computer system 105 may be a personal computer, a work station, a laptop computer, a set of computers, a dedicated computer, or the like. As referred to herein a set includes one or more elements. Computer system 105 may include a set of processors configured to execute one or more computer programs. Computer system 105 may also include one or more memory devices 120 on which computer code and any results generated by executing the computer code may be stored. The one or more memory devices may include one or more of a RAM, a ROM, a CD and CD drive, an optical drive, etc. Computer system 105 may also include a monitor 125, and one or more human interface devices, such as a keyboard 130, mouse 135, a puck, a joystick, etc. Computer system 105 may be a stand alone computer system, or may be coupled to the set of controls 110 for controlling the set of controls to thereby control the polishing of a workpiece. According to one embodiment, the computer system may include the set of controls 110. The set of controls may be coupled to the set of polishing devices, and may be configured to control the set of polishing devices as described below. According to one embodiment, computer system 105 is configured to store computer code and execute computer code to thereby embody various embodiments of the present invention.

Figure 2A:
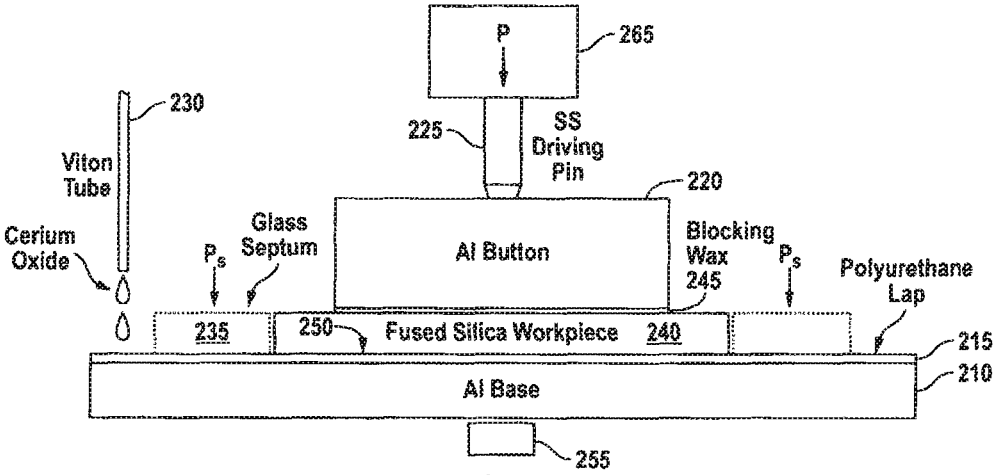
FIGS. 2A and 2B are a simplified cross-sectional view and a simplified top view of the set of polishing devices according to one embodiment of the present invention.
Figure 2B:
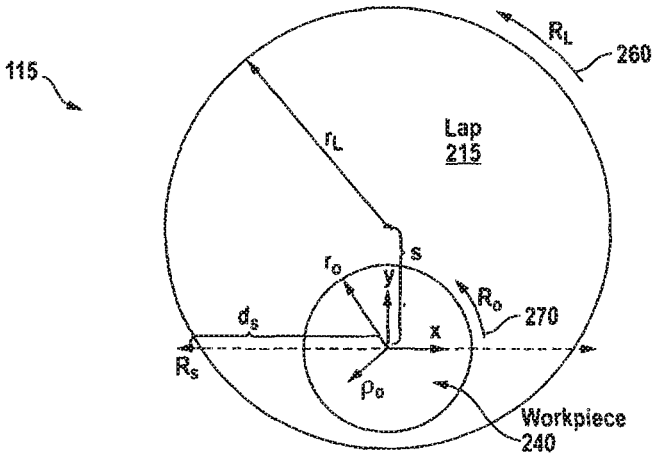

FIGS. 2A and 2B are a simplified cross-sectional view and a simplified top view of the set of polishing devices 115 according to one embodiment of the present invention. The set of polishing devices 115 includes a base 210, a lap 215, a mounting disk 220, a driving pin 225, and a viton tube 230. The set of polishing devices may also include a septum 235. Lap 215 may be a polyurethane lap and may be coupled to base 210, which may be an aluminum base. Viton tube 230 is configured to deliver a polishing solution onto the lap for polishing a workpiece 240. The workpiece may be a silica glass workpiece and may be attached to mounting disk 220 via an adhesive 245, such as blocking wax. The polishing solution supplied by the viton tube may be cerium oxide, which is a relatively commonly used polishing solution for silica glass. Note that devices other than a viton tube may be used for delivery a polishing solution.

Via a polishing process applied to the workpiece by the polishing system, a surface 250 of the workpiece disposed adjacent to the lap may be polished to a desired shape. According to one polishing embodiment of the present invention, the base and lap may be rotated by one or more motors 255 in the direction indicated by arrow 260 at a rotation rate of $R_L$. The workpiece may be rotated by the driving pin, which may be coupled to one or more motors 265 that are configured to rotate the driving pin and thereby rotate the workpiece. The workpiece may be rotated in a direction indicated by arrow 270 at a rotation rate of $R_O$. The workpiece may also be moved linearly (or stroked) by the driving pin in the plus and minus x direction through a stroke distance of plus and minus ds at a stroke rate direct $R_S$. The driving pin may be moved linearly by motors 265 or other devices to linearly move the workpiece. The stroke distance may be measured outward from a radius S (see FIG. 2B), which is perpendicular to the stroke direction. The driving pin may also be configured to be moved vertically up and down along the z axis (up in FIG. 2A, and out from the page in FIG. 2B) so that a gap may be set between the workpiece and the lap. As described below, the pressure resulting between the workpiece and lap is a function of the gap. Various mechanisms, well known to those of skill in the art, may be configured to move the workpiece relative to the base for setting the gap between the workpiece and the lap.

According to one embodiment, each control in the set of controls 110 may include a device having a variety of settings for setting the polishing parameters ($R_L$, $R_O$, $d_S$, $R_S$). The gap between the workpiece and the lap is described above. The set of controls may include knobs, sliders, switches, computer activated controls, and the like. According to one embodiment, in which computer system 105 includes the set of controls, the controls may be on-screen controls displayed on the computer monitor. The on-screen controls may control program code and computer interfaces for controlling the set of polishing parameters.

Figure 3:
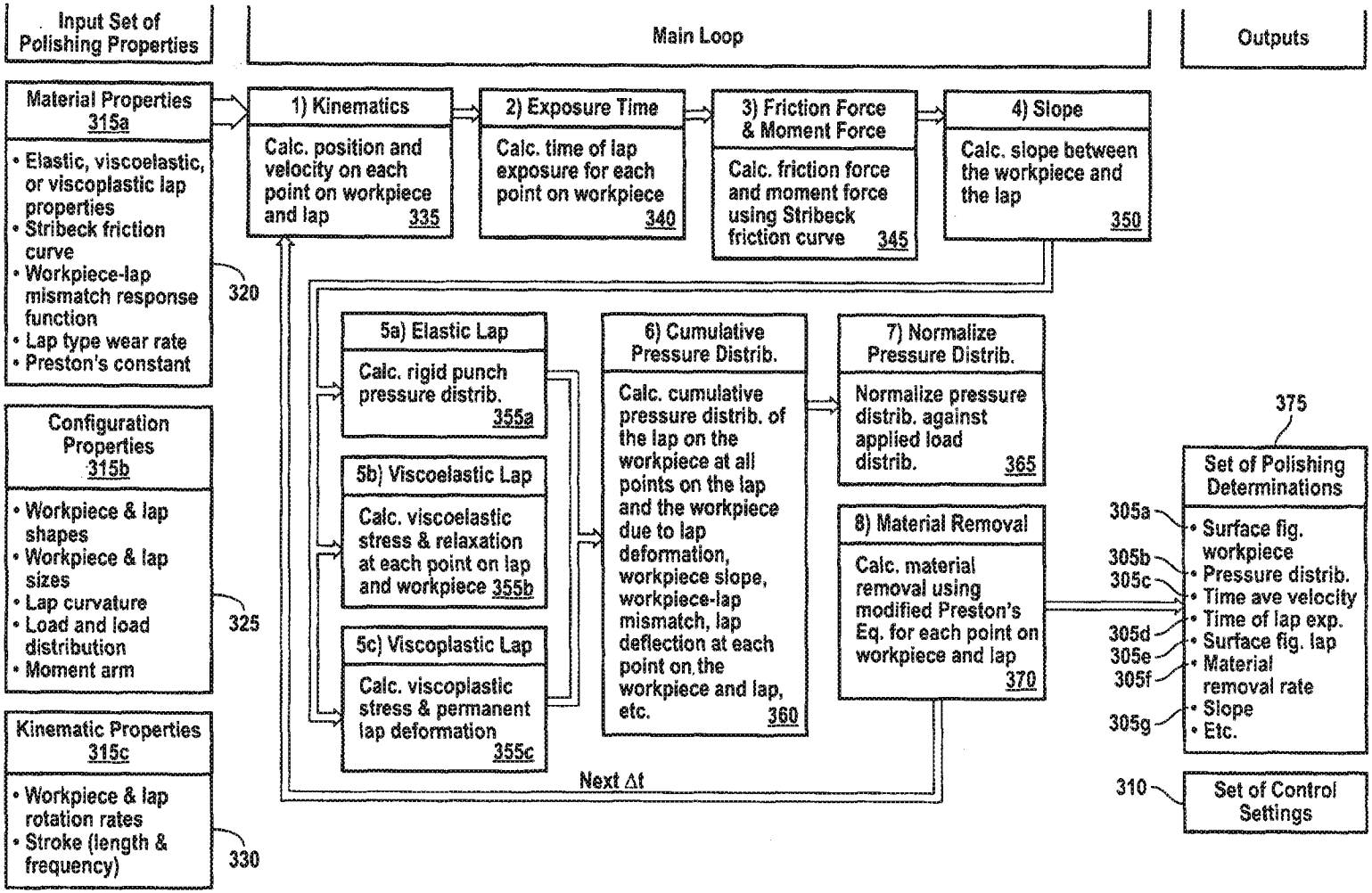
FIG. 3 is a high-level flow diagram of a computerized method for generating a set of polishing determinations and a set of control settings for a set of controls of a polishing system.

FIG. 3 is a high-level flow diagram of a computerized method 300 for generating a set of polishing determinations 305 and a set of control settings 310 for the set of controls 110 according to one embodiment of the present invention. Each polishing determination in the set of polishing determinations 305 is labeled in FIG. 3 with the base reference number 305 and an alphabetic suffix. It should be understood that the high-level flow diagram is exemplary. Those of skill in the art will understand that various steps in the method may be combined and addition steps may added without deviating from the spirit and purview of the described embodiment. The high-level flow diagram is not limiting on the claims. Computerized method 300 is first described in a high-level overview, and then is described in further detail thereafter. Computerized method 300 may be executed on polishing system 100. More specifically, many of the steps of computerized method 300 may be executed on the polishing system's computer system 105.

In high level overview, computerized method 300 simulates a polishing process on polishing system 100. The output of the computerized method includes a prediction for a shape of a surface of a workpiece under a set of polishing conditions, and a prediction for the set of control settings 310 for the set of controls 110. The shape of a surface of a workpiece is sometimes referred to herein as a surface figure. According to one embodiment of the present invention, computer system 105 is configured to receive a set of polishing parameters 315 (labeled 315*a*, 315*b*, and 315*c*) for a polishing process of a workpiece and iteratively determine the amount of material removed from the workpiece. Computer system 105 may also be configured to use the polishing parameters to determine the shape of the surface of the workpiece 305*a*, the pressure distribution between the workpiece and lap 305*b*, the time averaged velocity for the workpiece relative to the lap 305*c*, the amount of time the workpiece is exposed to the lap 305*d*, the shape of the surface of the lap 305*e*, the removal rate of material from the workpiece 305*f*, the slope of the workpiece relative to the lap 305*g*, and/or the like.

The set of polishing determinations 305 may be generated for a set of points on the workpiece and the lap. The set of polishing determinations may be for a set of successive time periods $\Delta t_1$, $\Delta t_2$, $\Delta t_3$ . . . $\Delta t_n$. The set of points may include hundreds, thousands, tens of thousands, or more points on the workpiece and/or lap. The temporal length of the time periods $\Delta t$ may be set as desired. For each latest time period $\Delta t$, the amount of material determined to be removed in the immediately prior time period $\Delta t$ is used by the computer system to determine the subsequent amount of material removal. That is, the computerized method uses the method's output (e.g., polishing determinations 305) as the input to the computerized method for successive temporal steps $\Delta t$. Based on the amount of material determined to be removed at each time period $\Delta t$, the set of control settings 310 may be determined by computer system 315. A human user or computer system 105 may use the set of control settings 310 to set the set of controls 110 on polishing system 100.

According to one embodiment, computer system 105 is configured to store and execute computer code in the form of a polishing model, which is configured to receive the set of polishing parameters 315 to generate the set of polishing determinations 305 and generate the set of control settings 310. According to one embodiment, the polishing model is a modified Preston's model shown in equation 1 below.

$$\frac{dh_i(x, y, t)}{dt} = k_p\mu(v_r(x, y, t))\sigma_o(x, y, t)v_r(x, y, t) \quad 1$$

The modified Preston's model is both a spatial and temporal model. The modified Preston's model takes into account the kinematics between the workpiece and the lap, and the nonuniformities in the pressure distribution between the workpiece and the lap. Both the kinematics and the nonuniformities in pressure may be empirically and/or theoretically determined and may be used in the modified Preston's model.

In the modified Preston's model, $$\frac{dh_i(x, y, t)}{dt}$$

is the instantaneous removal rate of material from a workpiece, at a given time t and a given position (x,y) on the workpiece. $\mu(v_r(x,y,t))$ is the friction coefficient between the workpiece and the lap. The friction coefficient is a function of the relative velocity $v_r(x,y,t)$ between the workpiece and the lap at the workpiece-lap interface. $\sigma_o(x,y,t)$ is the pressure distribution resulting from the applied pressure ($\sigma_o$) and the characteristics of the workpiece-lap contact. $k_p$ is the Preston's constant, which is a fundamental removal rate of material from the workpiece for a given polishing compound (e.g., ceria slurry). More specifically, the Preston's constant is the removal rate of material from the workpiece per unit pressure between the workpiece and the lap and the unit velocity between the points on the workpiece and the lap.

According to one embodiment, the method shown in FIG. 3, for determining material removal from the surface of a workpiece and determining settings for the controls of the polishing system, is based on the modified Preston's equation. The modified Preston's equation takes into account the empirically measured and/or theoretically determined effects of: 1) the frictional forces between the workpiece and the lap as function of relative velocity between the polishing particle and workpiece; 2) the relative velocity between the workpiece and lap based on various kinematics; and 3) the factors that affect the pressure distribution between the workpiece and the lap (such as, moment forces and workpiece tilt, lap viscoelasticity, and workpiece-lap interface mismatch). These effects are combined to generate the method shown in FIG. 3 and to generate a more global material removal model.

As described briefly above, the material removal and shape of a surface of a workpiece after polishing (e.g., ceria pad polishing) have been measured and analyzed as a function of kinematics, loading conditions, and polishing time. Also, the friction at the workpiece-lap interface, the slope of the workpiece relative to the lap plane, and lap viscoelastic properties have been measured and correlated to material removal. The results show that the relative velocity between the workpiece and the lap (i.e. the kinematics) and the pressure distribution determine the spatial and temporal material removal, and hence the final surface shape of the workpiece. In embodiments where the applied loading and relative velocity distribution over the workpiece are spatially uniform, a significant non-uniformity in material removal, and thus surface shape, is observed. This is due to a non-uniform pressure distribution resulting from: 1) a moment caused by a pivot point and interface friction forces; 2) viscoelastic relaxation of the polyurethane lap; and 3) a physical workpiece-lap interface mismatch. For completeness, both the kinematics and the non-uniformities in the pressure distribution are described below as the steps of computerized method 300 are described in further detail.

The high-level flow chart for the computerized method 300 shown in FIG. 3 is described in further detail immediately below. At a step 320, the computer system is configured to receive a set of material properties 315*a* for polishing system 100. The set of material properties 315*a* may be received by computer system 105 from a local memory, a remote memory on a network or the like. The material properties may include information for i) a lap type being used in polishing system 100, ii) a Stribeck friction curve, iii) a workpiece-lap mismatch response, and iv) Preston's constant ($k_p$). Each of material properties 315*a* is described in detail below.

At a step 325, the computer system is configured to receive a set of configuration properties 315*b* for a configuration of polishing system 100. The set of configuration properties 315*b* may be received by computer system 105 from a local memory, a remote memory on a network or the like. The set of configuration properties may include: i) the workpiece shape and the lap shape, ii) the workpiece size and the lap size, iii) the lap curvature, iv) the load and load distribution of the lap against the workpiece, and v) the moment of the workpiece relative to the lap. Each of configuration properties 315*b* is described in detail below.

At a step 330, the computer system is configured to receive a set of kinematic properties 315*c* for polishing system 100. The set of kinematic properties 315*c* may be received by computer system 105 from a local memory, a remote memory on a network or the like. The set of kinematic properties 315*c* may include: i) the rotation rate $R_L$ of the lap, ii) the rotation rate $R_O$ of the workpiece, iii) the stroke length $d_S$ of the workpiece, the stroke frequency $R_S$. The kinematic properties are generally well known by those of skill in the art.

Material Properties

As described briefly above, the set of material properties 315*a* may include: i) a lap type being used in polishing system 100, ii) a Stribeck friction curve, iii) a workpiece-lap mismatch response, iv) lap type wear rate, and iv) Preston's constant ($k_p$). According to one embodiment of the present invention, the information for the lap type may include information that identifies the lap as an elastic lap, a viscoelastic lap, a viscoplastic lap, or other lap type. Viscoelasticity in general is the property of materials that exhibit both viscous and elastic characteristics if deformed. A viscoelastic lap may be deformed (e.g., compressed) by an applied force, and after removal of the applied force or a reduction of the applied force, the molecules in the viscoelastic lap may relax and expand from the deformation. More specifically, viscous materials tend to resist shear flow and strain linearly with time if a stress is applied to the material. Elastic materials strain instantaneously when stretched and just as quickly return to their original state once the stress is removed. Viscoelastic materials have elements of both of these properties and, as such, exhibit time dependent strain.

Figure 4A:
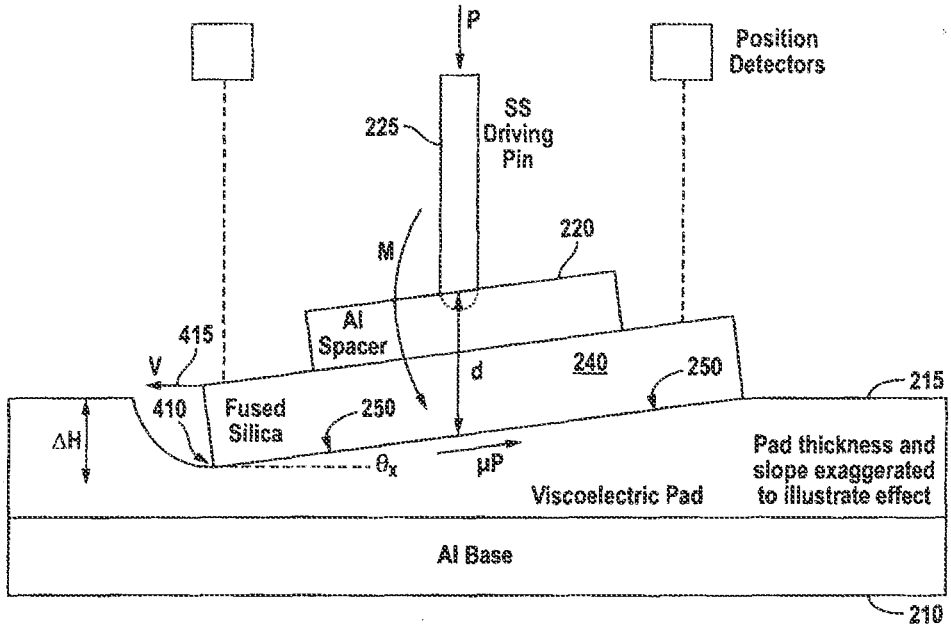
FIG. 4A is a simplified schematic of a viscoelastic lap deformed by the leading edge of a workpiece passing over the viscoelastic lap.
Figure 4B:
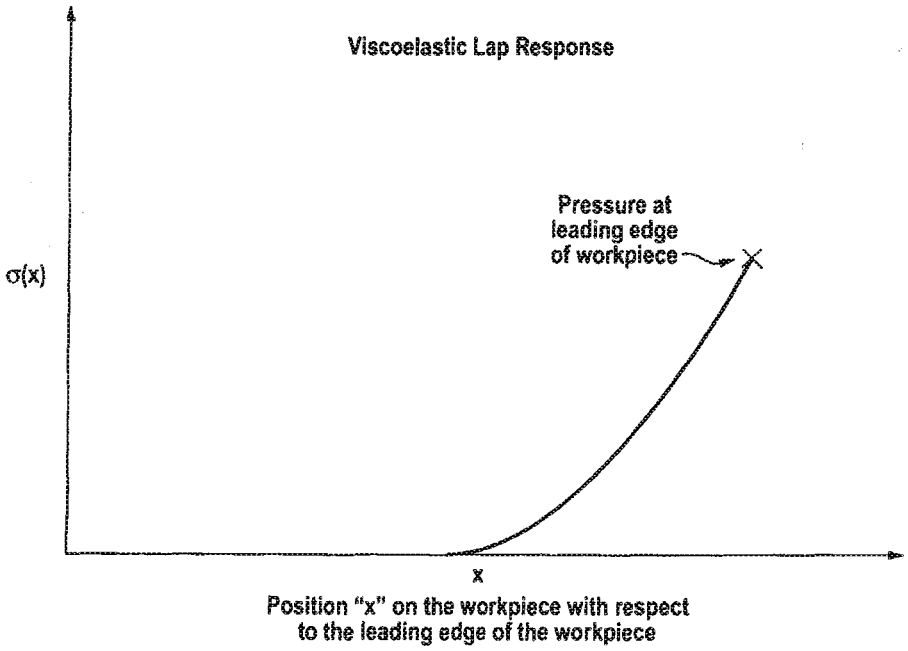
FIG. 4B is a simplified graph of the pressure gradient across the surface of the workpiece as a function of position on the surface with respect to a leading edge of the workpiece.

FIG. 4A is a simplified schematic of a viscoelastic lap (such as a polyurethane lap) deformed by the leading edge of the workpiece passing over the viscoelastic lap. Across the workpiece surface 250, the leading edge 410 of the workpiece is exposed to the highest pressure by the lap as the workpiece moves across the workpiece in the direction 415. As the lap relaxes from being deformed there may be a pressure gradient applied to the workpiece as the workpiece moves relative to the lap. FIG. 4B is a simplified graph of the pressure gradient across the surface of the workpiece as a function of position on the surface with respect to leading edge 410. The highest pressure applied to the workpiece is at the leading edge 410 and drops away from the leading edge. At subsequent steps in computerized method 300, this pressure gradient on the surface of the workpiece is combined with other pressure effects and pressure information to determine a cumulative pressure across the surface of the workpiece.

Figure 5:
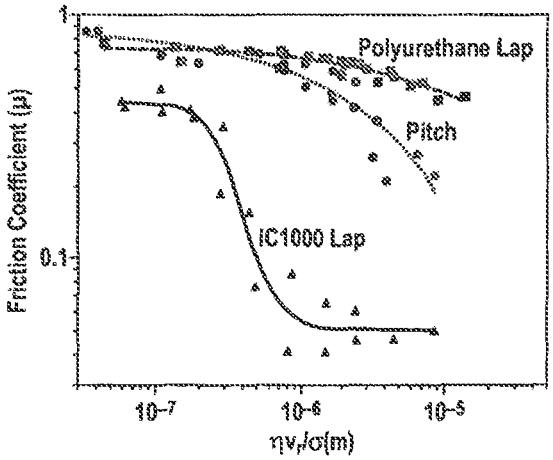
FIG. 5 is an example graph of a Stribeck friction curve for a particular lap type, such as a polyurethane lap.

FIG. 5 is an example graph of a Stribeck friction curve for a particular lap type, such as a polyurethane lap. A Stribeck friction curve provides the friction coefficient between the workpiece and the lap based on: i) the applied pressure between the workpiece and the lap, and ii) the relative velocity between the workpiece and the lap at each point on the workpiece and lap. The friction between the workpiece and the lap generally decreases with increased velocity between the workpiece and the lap as shown in FIG. 5. The friction between the workpiece and the lap generally increases with increased pressure between the workpiece and the lap. The Stribeck friction curve may be a function of the slurry. The Stribeck friction curve may be determined empirically for a lap.

In general, the contribution of interfacial friction to material removal (see equation 1 above) can be thought of as being proportional to the number of polishing particles making contact with the workpiece. The greater the number of particles making contact with the surface of the workpiece, the greater the friction, and the greater the removal rate of material from the surface. According to one embodiment of the present invention, the friction force (F) was measured as a function of applied load (P) and lap rotation rate ($R_L$). The friction coefficient (μ) for each measurement is then: μ=F/P. The magnitude of the friction between the workpiece and the lap may be determined by the mode of contact between the workpiece and the lap, the applied load, the characteristics of the slurry (e.g. viscosity), and the workpiece to lap relative velocity. It is common to describe dynamic friction coefficient μ as function of $$\frac{\eta_s v_r}{\sigma_o}$$

where $\eta_s$ is the slurry fluid viscosity. Note that the friction coefficient can change relatively significantly depending on the velocity and applied pressure. At relatively low values of $$\frac{\eta_s v_r}{\sigma_o} \text{ (e.g., } < 10^{-6} \text{ m)}$$

for the lap, the workpiece and the lap make mechanical contact (referred to as contact mode), and the friction coefficient is relatively high (0.7-0.8). At relatively high values of $$\frac{\eta_s v_r}{\sigma_o} \text{ (e.g., } > 10^{-5} \text{ m),}$$

the fluid pressure of the slurry carries the workpiece off of the lap (referred to as hydrodynamic mode), and the friction coefficient is relatively low (<0.02). Most conventional optical polishing is performed in contact mode, where the friction coefficient is large and does not significantly change. Notice in FIG. 5 that the polyurethane lap, pitch, and the IC1000 pad follow the same basic behavior with the friction coefficient on the Stribeck curve. However, the transition into hydrodynamic mode occurs at different values of $$\frac{\eta_s v_r}{\sigma_o}$$

depending, for example, on the properties of the lap material. For the polyurethane pad, the friction coefficient can be described by a sigmoidal curve, which is often used to describe the shape of the Stribeck curve, as:

$$\mu = 0.7 - \frac{0.6}{1 + \left(7.7 \times 10^4 \text{m}^{-1} \frac{n_s v_r}{\sigma_o}\right)}. \quad 2$$

According to one embodiment, the above equation 2 for the friction coefficient is used in the modified Preston's equation along with other terms described below to predict the surface shape of a workpiece and to determine the set of control settings for the set of controls for the polishing system.

Figure 6:
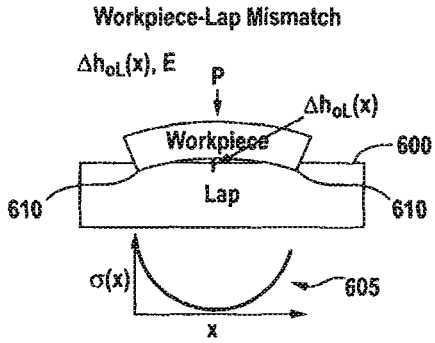
FIG. 6 is an example schematic of a typical mismatch in shape between a workpiece and a lap where the workpiece and/or the lap may have a curved surface.

FIG. 6 is an example schematic of a typical mismatch 600 in shape between a workpiece and a lap where the workpiece and/or the lap may have a curved surface. FIG. 6 also shows the workpiece-lap mismatch response 605 between the workpiece and the lap for the given mismatch 600. The workpiece-lap mismatch response, in general, is the pressure variation across the surface of the workpiece on the lap due to the mismatch in the surface shapes of the workpiece and the lap. Generally the pressure between the workpiece and the lap is greatest where the workpiece and/or the lap have a surface portion that project towards the other. As can be seen in the exemplary workpiece-lap mismatch response 605, the pressure is greatest between the workpiece and the lap towards the outside 610 of the workpiece where the surface of the workpiece has a maximum surface extension towards the lap. The workpiece-lap mismatch response may be determined based on a number of factors, such as variously shaped mismatches, the elasticity of the lap, and the like. As will be described below, the workpiece-lap mismatch response may be combined with other pressure information, to generate a pressure map for the surfaces of the workpiece and the lap.

Configuration Properties

As described briefly above, the set of configuration properties 315*b* may include: i) the workpiece shape and the lap shape, ii) the workpiece size and the lap size, iii) the lap curvature, iv) the load and load distribution of the lap against the workpiece, and v) the moment of the workpiece relative to the lap. The configuration properties generally describe certain aspects of how the set of polishing devices 115 are arranged.

According to one embodiment of the present invention, the workpiece shape supplied to computer system 105 includes information for the flatness and/or the curvature of the surface of the workpiece prior to polishing. Similarly, the lap shape supplied to computer system 105 includes information for the flatness of the surface of the lap prior to polishing. The workpiece size supplied to the computer system includes the size, e.g., the radius, of the workpiece that is to be polished, and the lap size is the size, e.g., the radius, of the lap. The lap curvature supplied to computer system 105 includes information for the surface curvature of the lap. The load and the load distribution include information for the load and load distribution applied to the workpiece, for example by the driving pin, and/or the lap.

The moment force information supplied to computer system 105 describes a force that tends to tilt the workpiece relative to the lap. The moment force arises from the frictional forces on the workpiece while the workpiece is in motion relative to the lap. Information for the moment force provided to computer system 105 may include information for the moment force and/or the pressure distribution across the surface of the workpiece from the moment force. FIG. 7 is a simplified schematic of the workpiece under a moment force from the frictional forces. The graph at the bottom of FIG. 7 shows the pressure distribution of the lap on the workpiece due to the frictional forces for the workpiece moving in the direction of arrow 700.

A moment force driven by the friction between the workpiece and the lap interface while in contact mode is described. Consider the workpiece-lap setup as shown in FIGS. 2A and 2B where the workpiece is held by a spindle and allowed to rotate. Using a force and moment balance while at equilibrium, the total load and moment are given by:

$$P = \int_{optic} \sigma(x, y)\, dx dy \quad 3$$

-continued $$M_x = \int_{optic} \sigma(x, y)\, y\, dx\, dy - F_y d = 0 \quad (4)$$

$$M_y = F_x d - \int_{optic} \sigma(x, y)\, x\, dx\, dy = 0 \quad (5)$$

where $F_x$ and $F_y$ are the components of the friction force and $M_x$ and $M_y$ are the moment in the x and y direction. Referring again to FIG. 7, this figure shows the result for workpiece slope during polishing. The slope increases (where the leading edge of the workpiece is lower than the trailing edge) with moment arm distance and applied pressure. This is qualitatively consistent with the above formalism, since it would result in higher pressure at the leading edge of the workpiece. The determined moment and slope (determined using the load and moment equations shown above) becomes more complicated with the addition of stroke in the kinematics where the moment and hence slope become time dependent (i.e. slope changes with position of the workpiece along the stroke trajectory). Also, any offset of the workpiece from the lap surface changes the pressure distribution over a smaller area of the workpiece, and any offset of the workpiece from the lap surface can also lead to an additional slope due to a center of gravity balance. The slope due to the moment combined with the viscoelastic lap contributions lead to a non-uniform pressure distribution.

Referring again to FIG. 3, at a step 335, computer system 105 is configured to calculate the position and velocity for each point on the workpiece as a function of time relative to the points on the lap (generally referred to as kinematics). The calculation at step 335 is carried out based on the set of kinematic properties 315*c* received by the computer system at step 330.

Material removal from a workpiece is a function of kinematic properties 315*c*. See equation 1 above. One of the kinematic properties that effect material removal from a workpiece is the relative velocity between the lap surface and the workpiece surface. The kinematics of the relative velocity of a polishing particle to the workpiece is described in further detail immediately below. Polishing particles having relatively high velocity typically provide for a relatively larger number of the polishing particles interacting with the workpiece surface, thus leading to greater material removal per unit time. Assuming that the workpiece-particle relative velocity is roughly equivalent to the workpiece-lap relative velocity (i.e., the polishing particle is essentially stationary relative to the lap), the kinematic parameters of the system may be used to calculate the relative velocity of the polishing particles for all points on the workpiece. It is convenient to describe the relative velocity in vector form as:

$$\vec{v}_r(x, y, t) = \left(\vec{R}_0 \times \vec{\rho}_0(x, y, t)\right) - \left(\vec{R}_L \times \vec{\rho}_0(x, y, t) - \vec{S}(t)\right) + \frac{d\vec{S}(t)}{dt} \quad (6)$$

where $\rho_o$ is a position on the workpiece given by coordinates x and y with the origin at the workpiece center, $\vec{R}_0$ and $\vec{R}_L$ are the rotation rates of the workpiece and lap in vector form directed along the z-axis, and $\vec{S}$ is the vector describing the separation between the geometric centers of the workpiece and lap (see FIGS. 2A and 2B). The first term on the right hand side of equation 6 describes the rotational velocity of the workpiece for some given position on the workpiece at the workpiece-center frame of reference. The second term on the right hand side of equation 6 describes the rotational velocity of the lap at the workpiece-center frame of reference. The final term on the right hand side of equation 6 describes the relative velocity due to the linear motion of the stroke. For a spindle polishing embodiment (e.g., polishing system 100), each of the terms above may be described in vector form as:

$$\vec{R}_o = \begin{pmatrix} 0 \\ 0 \\ R_o \end{pmatrix} \quad (7)$$

$$\vec{R}_o = \begin{pmatrix} 0 \\ 0 \\ R_L \end{pmatrix} \quad (8)$$

$$\vec{S} = \begin{pmatrix} d_s \sin(R_s, t) \\ s \\ 0 \end{pmatrix} \quad (9)$$

$$\vec{\rho}_o = \begin{pmatrix} \sqrt{x^2 + y^2}\, \sin(\arctan x/y) + 2\pi R_o t \\ \sqrt{x^2 + y^2}\, \cos(\arctan x/y) + 2\pi R_o t \\ 0 \end{pmatrix} \quad (10)$$

In order to describe a typical continuous polisher (CP), $d_s$ is set equal to 0. Since the relative velocity between the workpiece and a polishing particle can only lead to removal when the lap and workpiece are in contact, an additional condition for a non-zero relative velocity applies for the case of a circular lap:

$$|\vec{\rho}_o(x,y,t) - \vec{S}(t)| \le r_L. \quad (11)$$

The time average relative velocity is then given by:

$$V_r(x, y) = \frac{1}{t} \int_0^t \vec{v}_r(x, y, t')\, dt' \quad (12)$$

Using equations 6-12, the time average velocity may be calculated for a variety of kinematics as shown in FIGS. 8A-8D where $r_o$=0.05 m, $r_L$=0.10 m, RL=28 rpm. When $V_r$ is higher on the edge relative to the center, the workpiece generally would become convex, and when Vr is lower on the edges, the workpiece would become concave. FIG. 8A suggests that as the workpiece rotation rate is mismatched from the lap rotation rate, the workpiece would generally become more convex. FIGS. 8A and 8B suggest that increasing the separation distance tends to increase the time average velocity, and hence the removal rate of material from the workpiece surface. FIGS. 8C and 8D illustrate that increasing the stroke distance generally leads to lower velocities at the edge of the workpiece due to the edge of the workpiece spending more time off of the lap, and hence the workpiece would become more concave. These trends are consistent with those generally observed by opticians during conventional polishing.

Referring again to FIG. 3, at a step 340, the time of exposure of each point on the lap to the workpiece is calculated. More specifically, a point on the lap initially makes contact with the workpiece at one side of the workpiece (e.g., the leading edge of the workpiece based on the direction of travel of the workpiece relative to the lap), the point on the lap travels under the workpiece and then comes out from under the workpiece where the point no longer makes contact with the workpiece. This exposure time for each point on the lap is calculated based on the kinematics calculated in step 335 and the lap properties, such as the viscoelastic prosperities. The viscoelastic properties of the lap and the time of exposure (based on the viscoelastic properties of the lap) are described in detail immediately below. According to one embodiment of the present invention, the exposure time may be used to determine the pressure distribution of the lap on the workpiece (described immediately below).

For a viscoelastic lap loaded by an elastic workpiece, the pressure distribution on the workpiece ($\sigma(x,y)$) can be described by the heredity equation for a constant applied load as:

$$\sigma(x, y) = \int_0^{t_L(x,y)} E_{rel}(t_L(x, y) - t')\dot{\epsilon}(t')\,dt' \tag{13}$$

where $t_L(x,y)$ is the time of lap exposure at some point (x,y) on the workpiece for the corresponding point on the lap, $E_{rel}$ is the stress relaxation function for the viscoelastic lap material, and $\epsilon(t')$ is the lap strain rate. Each of these three parameters is analytically described below.

The time of lap exposure can be determined using a line path of some point on the lap ($x_L$,$y_L$) at the leading edge of the workpiece as it travels to some given point on the workpiece (x,y) as illustrated in the schematic in FIG. 9A. For the case of kinematics without stroke, the time of lap exposure is given by:

$$t_L(x, y) = \frac{1}{R_L}\arccos\left(\frac{x \cdot x_L(x, y) + (y+s)(y_L(x, y)+s)}{x^2 + (y+s)^2}\right) \tag{14}$$

$$y_L(x, y) = x^2 + (y+s)^2 - r_0^2 - s^2 \tag{15}$$

$$x_L(x, y) = \sqrt{r_0^2 - y_L(x, y)^2} \tag{16}$$

Note for every point selected on the workpiece (x,y), there is a unique corresponding point at the leading edge of the workpiece ($x_L$,$y_L$). FIG. 9B plots the calculated time of lap exposure $t_L(x,y)$ for the conditions used for a sample workpiece using the above three equations 1-3. The minimum time of lap exposure is at the leading edge of the workpiece and the maximum time of exposure is at the trailing edge on the side of the workpiece closest to the lap center. The asymmetry of the time of lap exposure is due to the fact that the velocity of a given point on the lap is lower closest to the lap center, which leads to longer times of lap exposure. For the example embodiment shown in FIG. 9B, the maximum time of lap exposure is 0.6 sec. A similar exercise, as described above, can be performed for the case with stroke added; however, the algebra is more complicated. Also, the time of lap exposure would change along the stroke cycle, whereas without stroke the time of lap exposure stays constant. The viscoelastic lap behavior can be modeled using a delayed elasticity viscosity model described in the known literature. FIG. 10 schematically illustrates the delayed elasticity viscosity model, which is comprised of two moduli (two springs) and one viscosity (dashpot). The creep compliance function J(t) and the stress relaxation function $E_{rel}(t)$ for the delayed elasticity viscosity model are described as:

$$J(t) = \frac{1}{E_1} + \frac{1}{E_2}\left(1 - e^{\frac{-t}{\tau_c}}\right) \tag{17}$$

$$E_{rel}(t) = \frac{E_1}{E_1 + E_2}\left(E_2 + E_1 e^{\frac{-t}{\tau_s}}\right) \tag{18}$$

where $\tau_c$ is the creep compliance time constant and $\tau_s$ is the stress relaxation time constant for the lap. For this model the following self similar relationships apply:

$$E_1 + E_2 = E \tag{19}$$

$$\tau_c = \frac{\eta}{E_2} \tag{20}$$

$$\tau_s = \frac{\eta}{E} \tag{21}$$

where E and $\eta$ are the bulk modulus and viscosity of the lap. This simple viscoelastic model (delayed elasticity model) is one possible viscoelastic model according to one embodiment of the present invention. According to other embodiments of the invention, other more complex, possibly more realistic models are considered for implementation.

According to one embodiment of the present invention, from dynamic mechanical analysis performed on a sample polyurethane lap, E=100 MPa and $\eta$=9.7×107 poise. Hence using equations 19, 20, and 21, $E_1$=97.75 MPa, $E_2$=2.25 MPa and $\tau_s$=0.1 sec. Note that the stress relaxation time constant ($\tau_s$) is less than the maximum time of lap exposure (see FIG. 9B), suggesting that a significant amount of stress relaxation can occur under these set of kinematics with this pad. With all of these parameters quantitatively known, the stress relaxation function (equation 13) is quantitatively defined.

The final component used to determine the pressure distribution (using equation 13) due to viscoelastic relaxation is the strain rate ($\epsilon(t')$)). The strain on the lap is constrained by the shape of the workpiece and its orientation with respect to the lap (i.e., the slope). For cases where the workpiece surface is flat, the strain as a function of workpiece position can then be defined as:

$$\varepsilon(x, y) = \frac{\tan(\theta_x)x}{t_{pad}} + \frac{\tan(\theta_y)y}{t_{pad}} + \varepsilon_0 \tag{22}$$

where $\theta_x$ and $\theta_y$ are the slopes of the workpiece in the x and y directions relative to the lap plane, $\epsilon_o$ is the elastic strain at the center of the workpiece, and $t_{pad}$ is the thickness of the viscoelastic pad. It is convenient to describe the strain as a function of time ($\epsilon(t)$) instead of position, which can be done using:

$$x = r_{arc}\cos\left(R_L t + \left(\arccos\frac{x_L}{r_{arc}}\right)\right) \tag{23}$$

$$y = r_{arc}\sin\left(R_L t + \left(\arccos\frac{x_L}{r_{arc}}\right)\right) - s \tag{24}$$

$$r_{arc} = \sqrt{x^2 + (y+s)^2} \tag{25}$$

where $r_{arc}$ is the arc radius for a given point ($x_L$, $y_L$) at the leading edge of the workpiece (see FIG. 9A) relative to the lap center. Substituting into equation 22, and then differentiating, gives the strain rate as:

$$\varepsilon(\tau) = -\frac{\tan(\theta_x)}{t_{pad}} r_{arc} \sin\left(R_L t + \left(\arccos\frac{x_L}{r_{arc}}\right)\right) - \frac{\tan(\theta_y)}{t_{pad}} r_{arc} \cos\left(R_L t + \left(\arccos\frac{x_L}{r_{arc}}\right)\right) \quad 26$$

Using equation 13-22, the pressure distribution on a non-rotated workpiece may be determined. FIG. 11A shows the calculated pressure distribution using the conditions described for a sample workpiece where the workpiece does not rotate. For comparison, the measured surface profile for the sample workpiece after 1 hour of polishing is shown in FIG. 11B. Note the leading edge of workpiece in each image is designated by a star. The observed removal is qualitatively consistent with the calculated pressure distribution where the leading edge experiences a much higher removal or pressure. For all of the other samples examined, the workpiece was rotated. Hence the average pressure distribution may be a time-average of the non-rotated pressure distribution rotated about the center of the workpiece, which can be described as:

$$\sigma(r) = \frac{1}{2\pi}\int_0^{2\pi} \sigma(r, \theta)\, d\theta \quad 27$$

where $\sigma(r,\theta)$ is the pressure distribution determined by equation 13 above in cylindrical coordinates. As the slope of the workpiece is increased relative to the lap plane, in equation 26, the time average rotated pressure distribution becomes more non-uniform, and hence the material removal becomes more non-uniform.

Referring again to FIG. 3, at a step 345 the friction, for the current time period Δt, at each point on the workpiece is determined based on the kinematics determined in step 335, and the Stribeck curve received by computer system 105 at step 320. The friction is a function of velocity of each point on the workpiece relative to the lap. The friction at a point determines the amount of material removal at the point. At step 345, the moment force on the workpiece is also determined. The determination of the moment force also provides angle of the workpiece relative to the lap. The angle between the workpiece and the lap effects the pressure distribution between the workpiece and the lap.

At a step 350, for the current time period Δt, the slope between the workpiece and the lap are determined from the angle between the workpiece and the lap determined in step 345. At step 350, the pressure distribution from the slope of workpiece relative to the lap is also determined.

At a step 355, for the current time period Δt, the pressure distribution based on the type of lap specified in step 320 is determined. For example, step 355*a* is executed if the lap is an elastic lap. For an elastic lap the rigid punch pressure distribution is determined. Step 355*b* is executed if the lap is a viscoelastic lap. For a viscoelastic lap, based on the exposure time determined in step 340, the viscoelastic pressure distribution of the lap against the workpiece is determined for each point on the workpiece. Sometimes pressure distribution is referred to herein as stress distribution. The relaxation of the lap at each point on the workpiece is also determined. Step 355*c* is executed if the lap is a viscoplastic lap. For a viscoplastic lap, the viscoplastic pressure distribution of the lap against the workpiece is determined for each point on the workpiece. The permanent deformation for all points on the lap is also determined for a workpiece pressing into the lap. The permanent deformation is a plastic deformation due to the plastic properties of the lap.

At a step 360, for the current time period Δt, the "cumulative" pressure of the lap on the workpiece is determined for all points on the workpiece as the workpiece moves relative to the lap. The cumulative pressure distribution is determined based on each of the pressure distributions, as described above, including the pressure distribution effects from the specific lap type (step 355), the pressure distribution from the workpiece-lap mismatch, and the pressure distribution from the slope between the workpiece and the lap, the pressure distribution from the lap curvature, and/or the pressure distribution from the lap deflection. The cumulative pressure distribution on the lap may be the product of the discrete pressure distributions from the various physical phenomena where each phenomenon has its own pressure distribution as described above. At a step 365, the cumulative pressure of the lap on the workpiece is normalized.

At a step 370, for the current time period Δt, the total material removal at each point on the workpiece is determined based on the modified Preston's equation $$\frac{dh_i(x, y, t)}{dt} = k_p \mu(v_r(x, y, t))\sigma_o(x, y, t) v_r(x, y, t). \quad 28$$

(described in detail above), where the friction coefficient $\mu(v_r(x,y,t))$ is determined for each point on the workpiece at step 345, the cumulative pressure distribution $\sigma_o(x,y,t)$ of the lap on the workpiece is determined for each point on the workpiece at steps 360 and 365, and the relative velocity $v_r(x,y,t)$ for each point on the workpiece relative to the lap determined at step 335.

At a step 375, based on the amount of material removal determined at step 370 and the initial known surface shape of the workpiece supplied to computer system 105 at step 325, a new surface shape of the workpiece may be determined by computer system 105 for each point on the workpiece, for example by simple subtraction. According to one embodiment of the present invention, the steps of the computerized method shown in FIG. 3 may be repeated one or more times using the newly determined surface shape of the workpiece to calculate total material removal across the surface of the workpiece for one or more subsequent time periods Δt.

According to one embodiment of the present invention, after a given number of time periods Δt, the surface shape of the workpiece determined at step 375 is compared to the desired-final surface shape of the workpiece. Based on the difference between the surface shape determined at step 375 and the desired-final surface shape, the set of control settings 310 for the set of controls 110 may be determined. For example, the set of control settings may be for changing the load on the workpiece, changing the workpiece rotation rate, the lap rotation rate, the stoke length, the stroke rate or the like.

At step 375, computer system 105 may be configured to determine other operating parameters, save the operating parameters, and/or report (e.g, display on the computer monitor) the operating parameters of the polishing devices 115. For example, the surface shape of the lap may be determined as the surface shape changes during polishing.

The modified Preston's equation may be applied to the lap to determine material removal for the lap for one or more successive time periods Δt. According to a further example, the cumulative pressure distribution may be determined, the time average velocity for each point on the workpiece may be determined, the time that each point on the workpiece is exposed to the lap may be determined. A material removal rate for the workpiece and/or the lap may be determined.

Lap Pre-Compression

According to another embodiment of the present invention, lap 215 is pre-compressed during polishing to flatten the lap surface. Pre-compressing the lap surface reduces the compression of the lap caused by the workpiece moving with respect to the lap. Reducing the amount of lap compression caused by the workpiece moving relative to the lap provides that the pressure distribution of the lap on the workpiece is relatively more uniform than the pressure distribution of a lap that is not pre-compressed. According to one embodiment, the lap is pre-compressed by placing pressure on septum 235 (see FIG. 2A) to thereby place pressure on the lap for pre-compression. According to one embodiment of the present invention, the unit pressure of septum 235 on lap 215 is three or more times the amount of the unit pressure of the workpiece on the lap. The septum may be pressed into the lap by one or more of a variety of devices. Those of skill in the art will know of forcing devices that may be coupled to the septum where the forcing device may be configured to press the septum into the lap at the above discussed unit pressure. According to one embodiment of the present invention, the septum is glass.

Lap Polishing

FIG. 12 is a simplified top view of a polishing system 1200 according to another embodiment of the present invention. Polishing system 1200 differs from polishing system 100 described above in that polishing system 1200 includes a septum 1205, which may not surround the workpiece. Septum 1205 may be generally triangular in shape as viewed from the top of the septum, and relatively planar as viewed from the side. Specifically, the septum may have first and second sides 1206 and 1207, respectively, which are relatively straight as viewed from the top of the septum as shown in FIG. 12. The first and second sides may join at an apex 1208. Apex 1208 may be configured to be at a center of the lap. The septum may further include a curved side 1209 as viewed from the top. The curved side may have a radius of curvature, which might match a radius of curvature of the lap. Septum 1205 may have an opening 1210 formed therein. Opening 1210 may have a radius that is substantially the same as the radius of the workpiece. The center of opening 1210 and the center of the workpiece 240 may be at substantially the same radial distance from the center of the lap 215, but may lie along different radius of the lap. According to one specific embodiment, septum 1205 may be positioned on the lap substantially opposite to the workpiece (i.e., on oppositely pointing radius of the lap) That is, the center of opening 1210 and the center of the workpiece may lie on the substantially same diameter of the lap. The inventors have discovered that a roughly triangular shaped septum polishes the lap in a relatively uniform manner as the workpiece is polished. Polishing the lap in a relatively uniform manner as the workpiece is polished provides that the uneven pressure distributions from the lap wearing in a non-uniform manner are lowered. According to one embodiment, polishing system 1200 does not include septum 235 as shown in FIG. 2A.

It is to be understood that the examples and embodiments described above are for illustrative purposes only and that various modifications or changes in light thereof will be suggested to persons skilled in the art, and are to be included within the spirit and purview of this application and scope of the appended claims. Therefore, the above description should not be understood as limiting the scope of the invention as defined by the claims.

What is claimed is:

1. A polishing system comprising:

a lap configured to contact a workpiece for polishing the workpiece;

a septum configured to contact the lap, wherein the septum has a substantially triangular shape in a plan view and has a top surface and a bottom surface, wherein the bottom surface is substantially planar, wherein the septum also has a first side, a second side, and a third side, wherein the first side, the second side, and the third side extend from the top surface to the bottom surface and the first side and the second side are joined at an apex configured to be at a center of the lap, and wherein the septum further has an aperture formed therein to receive the workpiece and the lap is configured to contact the workpiece through the aperture;

a first device configured to couple to the workpiece and place a first amount of pressure between the workpiece and the lap; and a second device coupled to the top surface of the septum and configured to place a second amount of pressure between the bottom surface of the septum and the lap to compress the lap as the workpiece is polished by the lap.

2. The polishing system of claim 1, wherein the compression of the lap by the septum is configured to inhibit the workpiece from compressing the lap as the workpiece is polished by the lap.

3. The polishing system of claim 1, wherein the compression of the lap by the septum is configured to substantially planarize the lap as the workpiece is polished by the lap.

4. The polishing system of claim 1, further comprising the workpiece.

5. The polishing system of claim 1 wherein the third side has a radius of curvature substantially equal to a radius of curvature of the lap.

6. The polishing system of claim 1 wherein the second pressure is three or more times the first pressure.

7. A method for pressing a lap with a septum to compress the lap during polishing of a workpiece to inhibit the workpiece from compressing the lap during the polishing, the method comprising:

pressing on a workpiece with a first forcing device to place a first amount of pressure between a lap and a workpiece; and pressing on a septum with a second forcing device to place a second amount of pressure between the septum and the lap, wherein the septum has a substantially triangular shape in a plan view, wherein the septum has a top surface, a substantially planar bottom surface, a first side and a second side joined at an apex, a third side, and an aperture formed therein and the workpiece is configured to contact the lap through the aperture, wherein the first side, the second side, and the third side extend from the top surface to the substantially planar bottom surface, wherein the apex is configured to be at a center of the lap.

8. The method of claim 7, further comprising rotating the lap with respect to the septum and the workpiece.

9. The method of claim 7 wherein the third side has a radius of curvature substantially equal to a radius of curvature of the lap.

10. The method of claim 7 wherein the second amount of pressure is three or more times greater than the first amount of pressure.

11. A polishing system configured to polish a lap, the polishing system comprising:

a lap configured to contact a workpiece for polishing the workpiece; and a septum configured to contact the lap, wherein:

the septum has a top surface, a bottom surface, a first side, a second side, a third side, wherein the first side, the second side, and the third side extend from the top surface to the bottom surface, and an aperture formed between the first, second, and third sides and passing from the top surface to the bottom surface, wherein the septum has a substantially triangular shape in a plan view;

the aperture has substantially the same radius as the workpiece;

the aperture has a center disposed at a radial distance from a center of the lap, and disposed along a first radial direction of the lap; and the workpiece has a center disposed at the radial distance from the center of the lap, and disposed along a second radial direction from the center of the lap.

12. The polishing system of claim 11, wherein the septum is substantially planar and configured to polish the lap to a substantially planar surface as the lap polishes the workpiece.

13. The polishing system of claim 11, wherein the first radial direction and the second radial direction are oppositely directed.

14. The polishing system of claim 11, further comprising the workpiece.

15. The polishing system of claim 11, wherein the the third side has a radius of curvature substantially equal to a radius of curvature of the lap.

* * * * *